United States Patent [19]

Byszewski et al.

[11] 4,413,204

[45] Nov. 1, 1983

[54] NON-UNIFORM RESISTANCE CATHODE BEAM MODE FLUORESCENT LAMP

[75] Inventors: Wojciech W. Byszewski, Arlington; A. Bowman Budinger, Westford; Joseph M. Proud, Wellesley Hills; Leslie A. Riseberg, Sudbury, all of Mass.

[73] Assignee: GTE Laboratories Incorporated, Waltham, Mass.

[21] Appl. No.: 336,815

[22] Filed: Jan. 4, 1982

[51] Int. Cl.[3] ..... H01J 1/62

[52] U.S. Cl. ..... 313/491; 313/310; 313/622; 315/67; 315/334

[58] Field of Search ..... 313/491, 497, 211, 212, 313/216, 310, 341; 315/67, 334

*Primary Examiner*—Harold Dixon

*Attorney, Agent, or Firm*—J. Stephen Yeo

[57] ABSTRACT

The lamp shown herein is a beam mode fluorescent lamp for general lighting applications. The lamp comprises a light transmitting envelope, having a phosphor coating on its inner surface, enclosing a thermionic cathode for emitting electrons and an anode for accelerating the electrons and forming an electron beam, and a fill material, such as mercury, which emits ultraviolet radiation upon excitation. The cathode configuration provides for the elimination of "hot spots" due to ion bombardment at the low potential end of the cathode and for higher overall cathode emission of electrons. Various methods are employed to accomplish these ends, such as: segmenting the cathode, pitch variation of the cathode winding; ion probes and a non-uniform primary coil wound around a larger mandrel wire.

10 Claims, 7 Drawing Figures

NON-UNIFORM RESISTANCE CATHODE BEAM MODE FLUORESCENT LAMP

CROSS REFERENCE TO RELATED APPLICATIONS

The present invention is an improvement to copending U.S. patent application Ser. No. 219,564, filed on Dec. 23, 1980, now abandoned for a "Beam Mode Fluorescent Lamp", assigned to the same assignee.

BACKGROUND OF THE INVENTION (1) Field of the Invention

The present invention pertains to beam mode discharge fluorescent lamps and more particularly to an arrangement for configuring the cathode within a beam mode discharge fluorescent lamp.

(2) Description of the Prior Art

U.S. patent application Ser. No. 219,564, filed on Dec. 23, 1980, now abandoned for a "Beam Mode Fluorescent Lamp", and assigned to the same assignee as the present invention, discloses a particular embodiment of a fluorescent lamp suitable for replacing the conventional incandescent bulb. Although incandescent lamps are inexpensive and convenient to use, they are considerably less efficient than fluorescent lamps.

In the above mentioned patent application, a single anode and cathode configuration is shown. A discharge is formed between the electrodes and electrons are emitted. Ions in the cathode potential drop region are accelerated by the field and bombard the cathode. This ion bombardment is not uniform and concentrates at the most negative end of the cathode. This leads to severe localized heating of the cathode with an elevated primary electron emission. The localized heating produces evaporation of the cathode coating with a resultant shortening of cathode life and darkening of the phosphor coating and increased chance of discharge "runaway" and cathode "burn-out".

SUMMARY OF THE INVENTION

Accordingly, it is an object of the present invention to provide a beam mode fluorescent lamp in which the ion emission along the length of the cathode is uniform.

It is another object of the present invention to provide a non-uniform resistance cathode beam mode fluorescent lamp with a longer cathode life.

It is yet another object of the present invention to provide a non-uniform resistance cathode beam mode fluorescent lamp, which substantially eliminates darkening of the phosphor coating of the envelope.

The subject beam mode fluorescent lamp includes a light transmitting envelope enclosing a fill material, which emits ultraviolet radiation upon excitation. A phosphor coating on an inner surface of the envelope emits visible light upon absorption of ultraviolet radiation.

A thermionic cathode arrangement for emitting electrons is located within the envelope. The cathode arrangement is connected to a DC power source by two conductors, one conductor connected to each end of the cathode. These same conductors also serve to support the cathode at a stationary location within the envelope.

An anode is connected to the positive end of the DC power source. The anode extends over and parallel to the cathode. This anode accelerates electrons emitted by the cathode to form an electron beam. The anode is constructed of a simple round wire segment. The anode is spaced apart from the cathode by a distance which is less than the electron range in the fill material. The structure of the anode permits acceleration of the corresponding electron beam with minimum collection of primary electrons due to the anode.

The fluorescent lamp includes a corresponding drift region within the envelope through which the electron beam drifts after passing through the anode. Electrons in the electron beam collide with atoms of the fill material in a drift region, thereby causing excitation of a portion of the film material atoms and emission of ultraviolet radiation and causing ionization of another portion of the fill material atoms and thereby producing secondary electrons. These secondary electrons cause further emissions of ultraviolet radiation. The fill material typically includes mercury and a noble gas, such as neon.

A potential drop exists between the anode and all points along the cathode. The cathode arrangement is divided into three segments. Two cathode segments are connected in parallel at the low potential end of the discharge space and a first end of this parallel connection is connected to the negative conductor. A third cathode segment is connected between another conductor, which is connected to ground, and the second end of the parallel connection of the first and second cathode segments.

This arrangement allows the third cathode segment to assume a higher temperature due to ohmic heating than the first and second cathode segments. The area where ion bombardment takes place is expanded. As a result, a relatively uniform temperature distribution and ele-tron emission is achieved along the length of the cathodes. In addition, cathode life is prolonged and darkening of the coating phosphor is inhibited. This arrangement applies equally well to two terminal or single electrode beam mode fluorescent lamps described in its cross referenced patent applications.

An AC version of the present invention is provided by arranging a cathode segment between to parallel cathode network segments. Two cathode segments are connected in parallel and to the first AC conductor. These two cathode segments are further series connected to a single cathode segment. The single cathode segment is connected to two other parallel cathode segments, which are further connected to a second AC conductor. On alternate half cycles of the AC as the low potential of the cathode alternates, ion discharge bombardment is regulated by the appropriate parallel connection of cathode segments.

Another alternative for uniform ion discharge is a non-uniformly wound cathode. The winding density is greatest at the high potential (negative) end of the cathode and decreases uniformly to the low potential end of the cathode. This cathode is then immersed in a highly emissive coating and binder.

Another alternative for uniform cathode heating is the use of one or more ion collecting probes electrically connected at the low potential end of the cathode. These probes are L-shaped and extend parallel to the length of the cathode, although not to the full extent of the cathode. The length of the probes may be adjusted to control the ratio of ion collection between the probe and cathode.

Another alternative for uniform ion discharge is the use of a uniformly wound mandrel wire and a non-uniformly wound primary coil around the mandrel wire. This primary coil has a high coil density at the high potential end of the cathode with a progressively lower coil density with distance from this end. A non-uniform resistance cathode is formed with the two coils electrically in parallel.

DESCRIPTION OF THE PREFERRED EMBODIMENT

Figure 1:
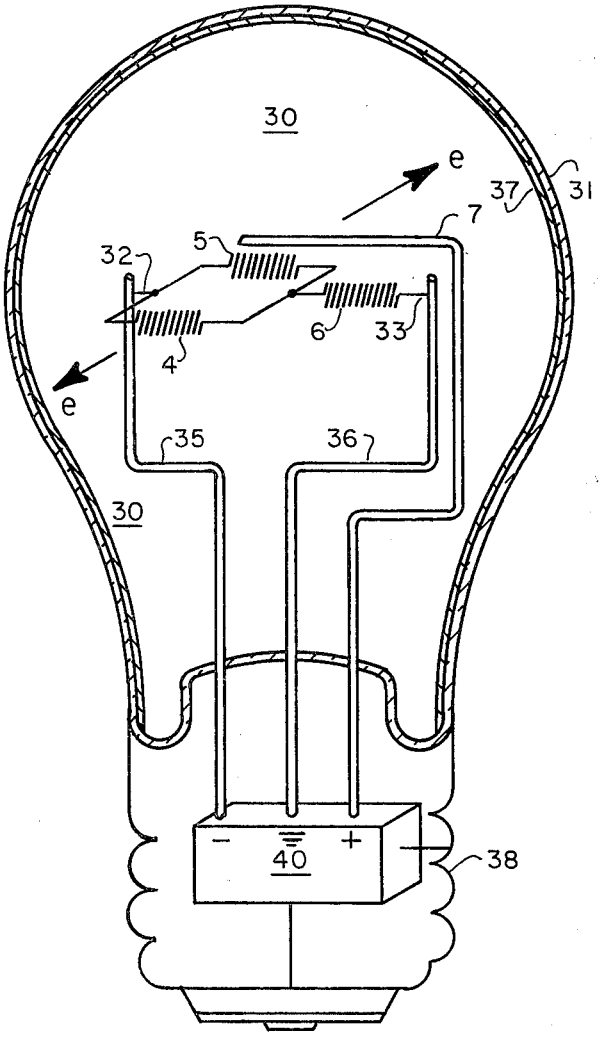
FIGS. 1 and 1A depict a segmented cathode non-uniform cathode beam mode fluorescent lamp embodying the principles of operation of the present invention.

Referring to FIG. 1, a segmented cathode non-uniform cathode beam mode fluorescent lamp for DC use is shown. A vacuum type lamp envelope 31 made of a light emitting substance, such as glass, encloses a discharge volume. The discharge volume contains a fill material which emits ultraviolet radiation upon excitation. A typical fill material includes mercury and a noble gas or mixtures of noble gases. A suitable noble gas is neon. The inner surface of the lamp envelope 31 has a phosphor coating 37 which emits visible light upon absorption of ultraviolet radiation. Also enclosed within the discharge volume by the lamp envelope 31 is an anode 7, conductors 35 and 36 supporting cathode segments 4, 5 and 6.

In general, the function of the cathode segments 4, 5 and 6 is to emit electrons, while the function of the anode 7 is to accelerate the electrons emitted by these cathode segments, while collecting only a minimal amount of primary electrons. Anode 7 is L-shaped and extends upwardly and parallel to cathode segments 4, 5 and 6.

Supporting conductors 35 and 36 provide for electrical connection of the external DC power supply 40 through the envelope 31 in a vacuum tight seal, as well as providing support for the structure of cathode segments 4, 5 and 6. Conductor 35 connects the negative output and conductor 36 the ground output of power supply 40 to the cathode segments 4, 5 and 6. Anode 7 is connected to the positive output of power supply 40. Alternatively, ground and the positive output may be common in which case only two conductors are necessary. Cathodes segments 4, 5 and 6 are of a thermonic type Cathodes segments 4 and 5 are connected in parallel and have one end 32 of their parallel connection connected to conductor 35. The other end of their parallel connection is connected in series with cathode 6. Cathode segment 6 is connected at its other end 33 to conductor 36. The ohmic resistance of cathodes segments 4, 5 and 6 is such that their total equals the single cathode which they replace with the resistance of cathodes segments 4 and 5 being approximately equal.

When the electrons have passed anode 7, they enter into a drift region 30 which extends from the anode to the bounds of the enclosing envelope 31.

The lamp further includes a base 38 which externally is of a conventional type suitable for inserting into an incandescent lamp socket.

Figure 3A:
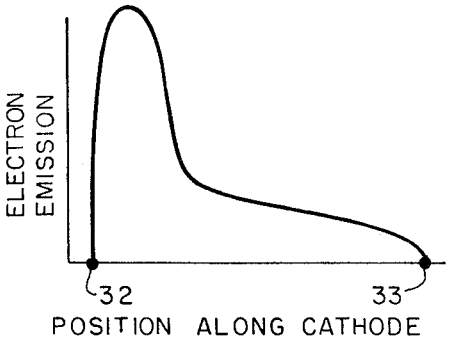
FIGS. 3A and 3B depict electron emission as a function of length along the cathode excluding and including the present invention respectively.
Figure 3B:
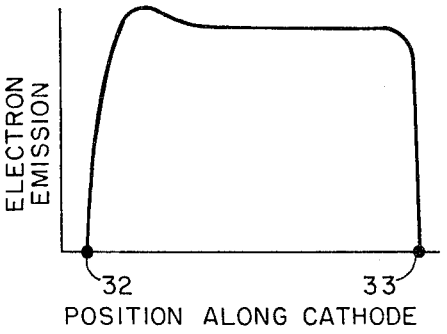

When a DC voltage is applied by power supply 40, a potential difference exists between anode 7 and all points along cathodes 4, 5 and 6. A potential drop also exists between ends 32 and 33 of the cathode structure. Since cathodes 4 and 5 are connected in parallel at the lower potential end 32 of the discharge, cathode 6 will be at a higher temperature due to ohmic heating than cathodes 4 and 5. This heating difference results in a relatively uniform temperature distribution and uniform electron emission distribution along the length of the cathodes between points 32 and 33 as shown by FIG. 3B. FIG. 3A shows the non-uniform electron emission distribution expected from a uniformly warm cathode.

Figure 1A:
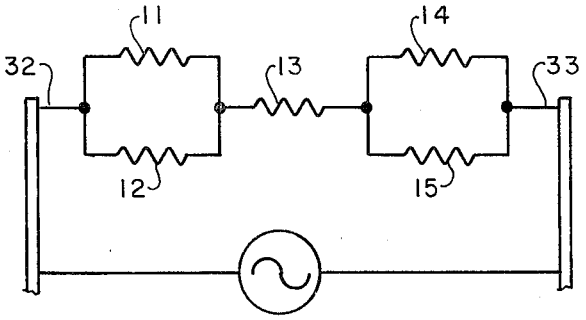

Referring to FIG. 1A, an AC arrangement of the present invention is shown. Cathodes 11 and 12 are connected in parallel with one end connected to the first conductor at point 32. The other end of cathodes 11 and 12 is connected in series connected to cathode 13. Cathode 13 is series connected to the parallel connection of cathodes 14 and 15. Cathodes 14 and 15 are connected to the second conductor at point 33. On one-half cycle of the AC voltage, point 32 will be negative and cathodes 11 and 12 will operate to increase the temperature and electron emission of cathode 13 as similar to the DC operation indicated above. On the alternate half cycle of the AC voltage, point 33 will be negative and cathodes 14 and 15 will operate to raise the temperature and electron emission of cathode 13. Thereby during both half cycles, the electron emission is made relatively uniform as shown in FIG. 3B.

Figure 2A:
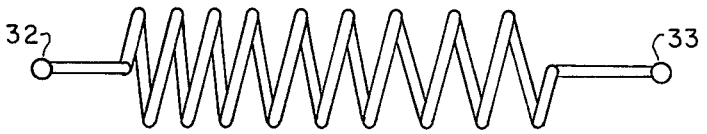
FIGS. 2A through 2C show alternate embodiments for a non-uniform cathode beam mode fluorescent lamp.

FIG. 2A shows another embodiment of the present invention. A non-uniformly wound cathode is connected between points 32 and 33. The coil density and electrical resistance is greatest at the high potential end 32 of the cathode. The winding pitch is then varied while the coil is wound so that the winding density and electrical resistance is relatively less at the low potential end 33 of the cathode.

Figure 2B:
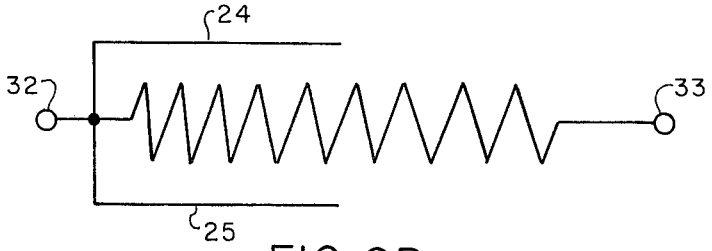

FIG. 2B shows another embodiment of the present invention employing two ion collecting probes 24 and 25 connected to the low potential end 32 of the cathode. The probes 24 and 25 extend parallel to the cathode and opposite to each other. One or more ion probes serve to collect some of the ions in order to more uniformly heat the filament, producing more uniform electron emission along the cathode from end 32 to end 33.

Figure 2C:
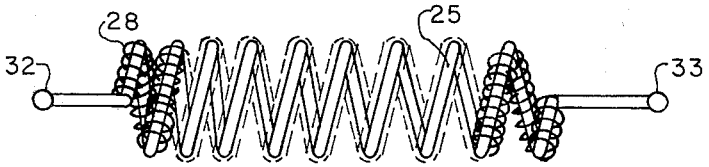

FIG. 2C depicts another alternative embodiment of the present invention. Primary coil wire 28 is non-uniformly wound around mandrel wire 25. Then mandrel wire 25 is uniformly wound. Primary coil wire has a high winding density at the high potential end 32 and a relative lower density at low end 33. Wires 28 and 25 are electrically in shunt. As a result, a non-uniform resistance cathode is formed.

FIG. 3A depicts the electron emission along the length of a single segment cathode, of uniform resistance, such as those mentioned in the prior art. FIG. 3B depicts the electron emission along the length of the cathode between the same points with the cathode arrangements of FIGS. 1 and 2.

Although a preferred embodiment of the invention has been illustrated, and that form described in detail, it will be readily apparent to those skilled in the art that various modifications may be made therein, without departing from the spirit of the invention or from the scope of the appended claims. For example, the dual cathode beam mode fluorescent lamp which is the subject of cross referenced patent application Ser. No.

337,046, filed Jan. 4, 1982 may have dual non-uniform resistance cathodes.

What is claimed is:

1. A non-uniform resistance cathode beam mode fluorescent lamp comprising:

a light transmitting envelope enclosing a fill material which emits ultraviolet radiation upon excitation;

a phosphor coating, which emits visible light upon absorption of ultraviolet radiation, on an inner surface of said envelope;

a power source external to said envelope;

at least one thermionic cathode having first and second ends located within said envelope for emitting electrons;

an anode located within said envelope for accelerating said electrons and forming an electron beam in response to a voltage applied between said anode and said cathode;

a drift region within said envelope through which said electron beam drifts after passing through said anode;

means for connecting said cathode and said anode to said power source;

said thermionic cathode including resistance means for providing for increasing the emission of said electrons along an area proximal to said first end of said cathode and said means for decreasing the emission of said electrons proximal to said second end of said cathode whereby the emission of said electrons is substantially uniform along said cathode length.

2. A non-uniform resistance cathode beam mode fluorescent lamp as claimed in claim 1, wherein said resistance means includes first, second and third thermionic cathode segments, said first and second cathode segments connected in parallel to said means for connecting and series connected with said third cathode segment and said third cathode segment connected to said means for connecting.

3. A non-uniform resistance cathode beam mode fluorescent lamp as claimed in claim 2, wherein said power source provides DC power for operating said lamp.

4. A non-uniform resistance cathode beam mode fluorescent lamp as claimed in claim 1, wherein said resistance means includes first, second, third, fourth and fifth thermionic cathode segments; said first and second cathode segments connected in parallel and to said means for connecting, said fourth and fifth cathode segments connected in parallel and to said means for connecting and said third cathode segment connected between said common connection of said first and second cathode segments and the common connection of said fourth and fifth cathode segments.

5. A non-uniform resistance cathode beam mode fluorescent lamp as claimed in claim 4, wherein said power source provides AC power for operating said lamp.

6. A non-uniform resistance cathode beam mode fluorescent lamp as claimed in claim 1, wherein said resistance means includes a non-uniformly wound coil having a highly emissive coating and binder connected between said means for connecting.

7. A non-uniform resistance cathode beam mode fluorescent lamp as claimed in claim 1, wherein said resistance means includes a uniformly wound mandrel wire and a smaller diameter non-uniformly wound primary coil wire about said mandrel wire.

8. A non-uniform resistance cathode beam mode fluorescent lamp as claimed in claim 1, wherein said means includes at least one L-shaped ion collecting probe connected to said first end of said cathode and extending parallel to said cathode for a predetermined length of said cathode.

9. A non-uniform resistance cathode beam mode fluorescent lamp as claimed in claim 1, wherein said fill material includes mercury; and a noble gas.

10. A non-uniform resistance cathode beam mode fluorescent lamp as claimed in claim 1, wherein there is further included a lamp base enclosing said power source, whereby said lamp can be operated directly from AC power.

* * * * *